US006637503B1

(12) United States Patent
Pospíšil et al.

(10) Patent No.: US 6,637,503 B1
(45) Date of Patent: Oct. 28, 2003

(54) LOWER CYCLONE HEAT EXCHANGER

(76) Inventors: Jaroslav Pospíšil, Žerotínovo 6, CZ-750 00 Př erov (CZ); Josef Žajdlík, Interbrigadistú 7, CZ-750 00 Př erov (CZ); Zdeně k Michálek, Bezruć ova 21, 750 00 Př erov (CZ); Petr Krejčí , Na Odpolerú 11, CZ-750 02 Př erov (CZ); Alois Pumprla, Pod Skalkou 2, CZ-750 00 Př erov (CZ)

( * ) Notice: Subject to any disclaimer, the term of this patent is extended or adjusted under 35 U.S.C. 154(b) by 0 days.

(21) Appl. No.: 09/913,888

(22) PCT Filed: Feb. 15, 2000

(86) PCT No.: PCT/CZ00/00006

§ 371 (c)(1),
(2), (4) Date: Aug. 17, 2001

(87) PCT Pub. No.: WO00/49356

PCT Pub. Date: Aug. 24, 2000

(30) Foreign Application Priority Data

Feb. 18, 1999 (CZ) ..... 544-99

(51) Int. Cl.[7] ..... F28D 15/00
(52) U.S. Cl. ..... 165/104.16; 432/106; 106/771
(58) Field of Search ..... 165/104.16, 108; 106/761, 747, 771; 432/14, 106

(56) References Cited

U.S. PATENT DOCUMENTS 3,904,353 A * 9/1975 Bosshard et al. ..... 432/14
4,022,568 A * 5/1977 Meedom ..... 432/14
4,045,162 A * 8/1977 Christiansen et al. ..... 432/106
4,094,626 A * 6/1978 Boyhont et al. ..... 432/106
4,896,631 A * 1/1990 Holm et al. ..... 165/104.16
5,244,383 A * 9/1993 Kreft et al. ..... 432/106
5,626,088 A * 5/1997 Hiltumen et al. ..... 165/104.16
6,444,026 B1 * 9/2001 Steffer et al. ..... 106/771
6,447,598 B2 * 9/2002 Kuhuke et al. ..... 106/761

* cited by examiner

*Primary Examiner*—Henry Bennett
*Assistant Examiner*—Terrell McKinnon
(74) *Attorney, Agent, or Firm*—Edward G. Greive

(57) ABSTRACT

A lower heat exchanger for preheating powdered raw materials has a system of cyclones. The exchanger is divided into a high temperature part and a low temperature part, mutually interconnected with an interconnecting tube of hot gas. Lowest member of low temperature part is a counter current shaft exchanger having an input under the level of hot gas output from the highest cyclone of high temperature part. Heated-up powdered raw material is transported from the low temperature part into the high temperature part by a transport tube, to which the hot gas stream is led. To this stream, powdered raw material from the output of counter current shaft exchanger is led. To the output tube arranged between the input chamber of a rotary kiln and the first cyclone of high temperature part, the inputs for fuel, combustion gas, hot gasses, and/or precalcined raw material are ended.

4 Claims, 1 Drawing Sheet

LOWER CYCLONE HEAT EXCHANGER

TECHNICAL FIELD

Figure 1:
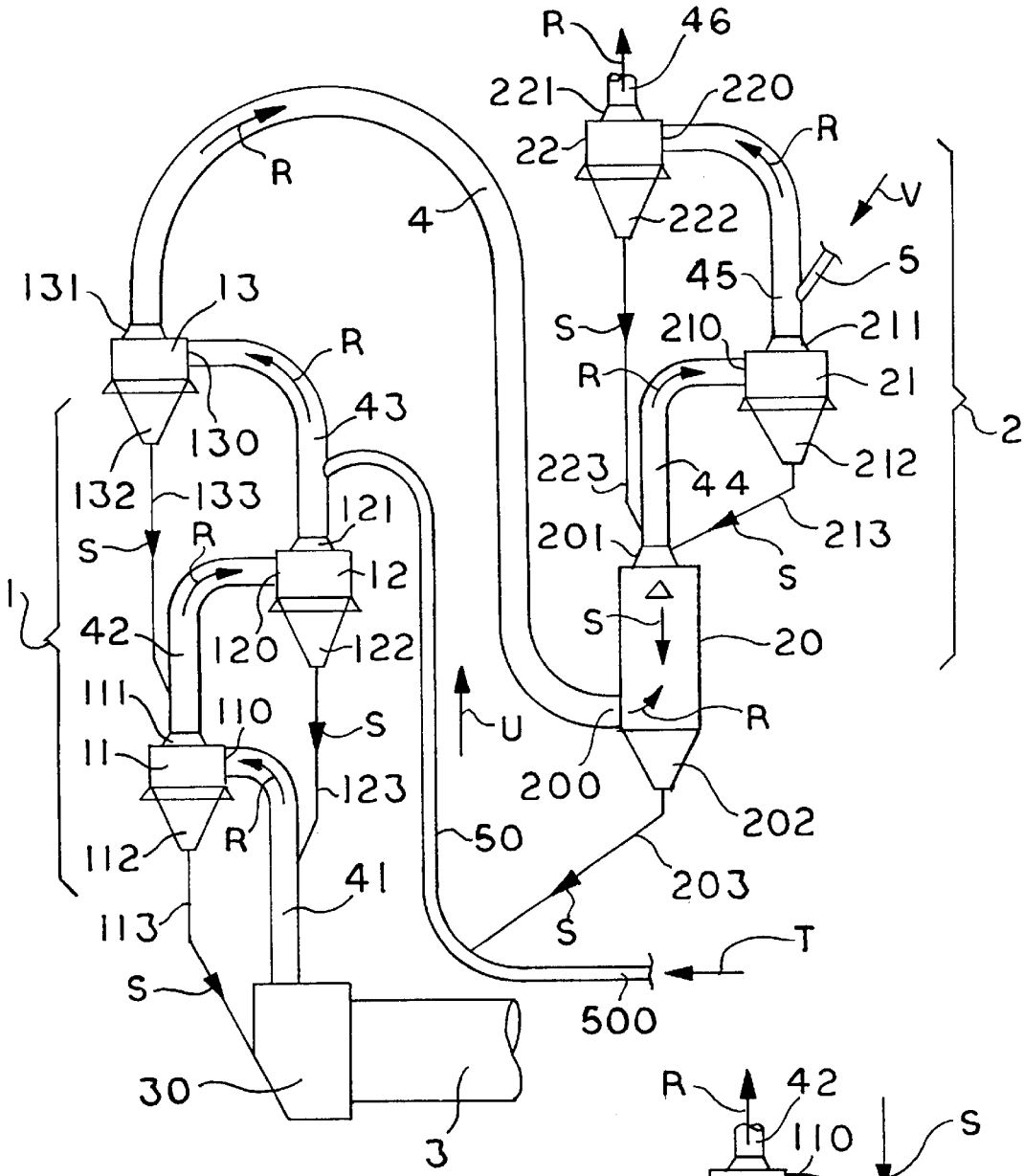

The invention deals with a lower, that means in high reduced, cyclone heat exchanger for preheating of powdered raw material, where the exchanger is consisting from a set of cyclones and which is divided into two parts, a high temperature part closer to the hot gas source and a low temperature part, whereas the high temperature part and low temperature part are mutually interconnected with a interconnecting tube and which are mutually on different height level such a way that the input to the low temperature part is situated lower as the output from the high temperature part.

BACKGROUND ART

The up to now known cyclone heat exchangers have in regard to their serial sequencing of individual cyclones and their functionally necessary height difference a considerable building height what poses high demands both to the structure and to assembly of equipment, and also to their operation and maintenance. An other indispensable disadvantage of high structure is the necessity of observation of design and building limitation at realization of the system in area with higher seismic activity. At some constructions the problem of excessive building height is solved at the expense of increasing of dimensions of technologic equipment and to tile prejudice of fluent material and gas movement during the technological process.

It is also known the construction according to patent application (PV) no. 4319, which partly solves the problem of excessive building height or the problem of undesirable increasing of dimensions of technological equipment by means of division of the system of cyclones to two parts, a high temperature part and to a low temperature part, which are located beside each other whereas the hot gas is led from the high temperature part to the low temperature part with a interconnecting tube, which starts in the last cyclone of high temperature part and ends in the first cyclone of low temperature part. For ensuring tile correct function of the equipment it is necessary to provide on the end of the interconnecting tube a returning loop, which is lying under the level of first cyclone of low temperature part. By this however a part of advantage of decreasing of total height of exchanger is lost and also in the return loop a part of heated up raw material is settled necessarily, by which beside others the capacity of equipment is decreased. For removal of undesired deposit the return loop has to be provided with an appropriate lockable opening which, in regard especially to necessary temperature insulation of the return loop, complicates the construction solution of the exchanger. Beside the above mentioned also the length of interconnecting tube is unprofitably increased.

DISCLOSURE OF INVENTION

The disadvantages of up to now realized construction arrangement is in essential part removed by the object of this invention, which is one in height reduced heat exchanger for preheating of powdered raw material, composed from system of cyclones, where the exchanger is divided into two parts, to a high temperature part closer to the hot gas source and to a low temperature part, where each part is composed from at least two serially one after the other arranged cyclones which are on different height level and which are mutually interconnected with a connecting tube of hot gas such a way, that the input of first cyclone is connected to the hot gas source and tile output from each cyclone is assigned to the input of next cyclone, where the output of separated powdered raw material is from each cyclone led to the beginning of the tube assigned to the output of hot gas from the previous cyclone and that the high temperature part and low temperature part of the exchanger are mutually interconnected with an interconnecting tube and the two parts are situated in different height level so, that the input to the low temperature part is situated lower as the output from the high temperature part and that the high temperature part is further provided with a transport tube, which is ended to the tube, connecting the supply of hot gas to its highest cyclone and to which the output tube of low temperature part of heat exchanger is ended.

The essence of the invention is that the lower member of low temperature part is composed from a shaft exchanger where the output of which is ended to the transport tube and where the input part of the transport tube is located under the level of powdered raw material output from the shaft exchanger.

An other essence of the invention is that into the output tube—arranged between the input chamber of rotary kiln and the first cyclone of high temperature part—the input of fuel and input of combustion gas are ended.

The essence of the invention at the end is that into the output tube—arranged between the input chamber of rotary kiln and the first cyclone of high temperature part the input of hot gas and precalcined raw material are ended.

With embodiment of in height reduced heat exchanger according to the invention the advantages of cyclone exchangers divided into a high temperature part and to a low temperature part will be preserved, and same time the disadvantageous loop on their interconnecting tube will be removed. This way the length of interconnecting tube will be principally decreased and namely the necessity of return loop formation on its end before the ending to the first member of low temperature part of cyclone exchanger will be removed. With it also the improvement of heat efficiency of heat exchanger divided to a high temperature part and to a low temperature is connected and at last but not least the improvement of operational conditions is achieved in regard to the fact that in the return loop of known equipment beside others a part of through the interconnecting tube transported powdered raw material is deposited and where such deposit has to be time to time removed and this removal necessarily evoke at recently used constructions the realization of working manholes eventually also in the connected transport means of this interconnecting tube. And as not at the end the object of this invention limits the otherwise necessary heavy work ill with heat and dust loaded environment.

OVERVIEW OF THE PICTURES ON THE DRAWING

Figure 2:
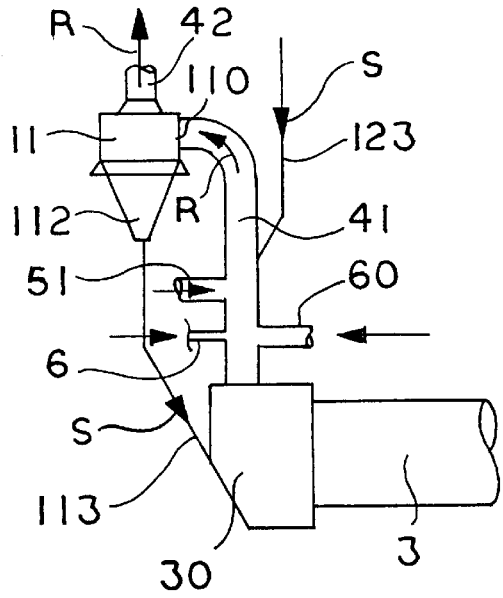

An example of embodiment of equipment according to the invention is demonstrated on the attached drawing, where on the FIG. 1 the system of in height reduced exchanger and on the FIG. 2 a changed construction version of output tube form picture no. 1 are demonstrated.

EXAMPLES OF EMBODIMENT OF THE INVENTION

The in height reduced heat exchanger is in the example of embodiment according to picture no. 1 divided into two parts, to a high temperature part 1 and to a low temperature part 2.

The high temperature part 1 is composed from three cyclones, from the first cyclone 11 with the hot gas input 110, hot gas output 111 and raw material output 112, from the second cyclone 12 with the hot gas input 120, hot gas output 121 and raw material output 122, and from the third cyclone 13 with the hot gas input 130, hot gas output 131 and raw material output 132. The cyclones It, 12 and 13 are mutually interconnected in direction of the hot gas stream consecutively such a way, that the output 111 of the first cyclone 11 is with the tube 42 connected with the input 120 of the second cyclone 12 where its output 121 is with the tube 43 connected with the input 130 of the third cyclone 13. The input 110 of first cyclone 11 is with the output tube 41 connected to the input chamber 30 of rotary kiln 3. The output 132 of third cyclone 13 is with help of the output tube 133 led to the lower part of tube 42 and similarly the output 122 of second cyclone 12 is led to the lower part of tube 41. The raw material output 112 from the first cyclone 11 is finally led with the output tube 113 to the input chamber 30 of rotary kiln 3 to next heat processing.

The low temperature part 2 is composed from a counter current shaft exchanger 20 with hot gas input 200, with hot gas output 201 and raw material output 202, further from the lower cyclone 21 with the hot gas input 210, hot gas output 211 and raw material output 212 and from the upper cyclone 22 with the hot gas input 220, hot gas output 221 and raw material output 222. The design of counter current shaft exchanger 20 is enough known in the practice and it has no influence to the essence of the invention and therefor it is not further detailed described. Similarly as at the high temperature part 1 also here the counter current shaft exchanger 20 and the cyclones 21, 22 mutually interconnected in direction R of the hot gas stream such a way, that the output 201 of the counter current shaft exchanger 20 is with the tube 44 connected with the input 210 of the lower cyclone 21, where its output 211 is with tile tube 45 connected with the input 220 of the upper cyclone 22. Its output 221 then ends the area of heat exchanger according to the example embodiment of invention and it is with the output tube 46 connected to the next technological part. The output 222 of upper cyclone 22 is with help of output tube 223 ended to the lower part of tube 44.

The high temperature part 1 and the low temperature part 2 are mutually interconnected with the connecting hot gas tube 4, which connects the output 131 of the highest—third cyclone 13 of high temperature part 1 with the input 200 of the counter current-shaft exchanger 20 in the low temperature part 2. The high temperature part 1 is in comparison to the low temperature part 2 situated in different height such a way, that the connection of input 130 of the highest, e.g. of third cyclone 13, is higher as the connection of the end of interconnecting tube 4 to the input 200 of tile counter current shaft exchanger 20.

The raw material input 5, where this raw material has to be preheated before tile input to the input chamber 30 of rotary kiln 3, is ended to the lower part of the tube 45 and after passing the low temperature part 2 is led to the third—the highest—cyclone 13 of the high temperature part 1 by mean of the tube 50, which is ended to the lower part of the tube 43 between its second cyclone 12 and the third cyclone 13. The transport is realized with help of hot gas stream, which is in the lower part 500 of the transport tube 50 led in direction of the arrow T. To the warm gas stream is through the output tube 203 led the output 202 of counter current shaft exchanger 20 of the low temperature part 2.

The design of in height reduced heat exchanger according to the invention is further advantageously completed such a way, that into the output tube 41, with which the input chamber 30 of rotary kiln 3 is connected with the hot gas input 110 to the first cyclone 11, an additional fuel supply 6 and combustion air supply 60 is led, or the gas input 51 and precalcinated raw material input, eventually the both.

The function of in height reduced heat exchanger according the invention is as follows. The powdered raw material, in this case raw material farina for dry method of cement clinker production, is fed with the output tube 113 into the input chamber 30 of rotary kiln 3. On contrary from the input chamber 30, through the output tube 41 the hot gas is taken away, where this hot gas has been created in the previous heat process and it is transporting a considerable amount of thermal energy. This hot gas is passing then stepwise in direction of the arrows R through output tubes 41 and tubes 42 and 43 and through the first cyclone 11, the second cyclone 12 and the third cyclone 13 of the high temperature part 1 of the exchanger and further it is led with the interconnecting tube 4 to counter current shaft exchanger 20 of the low temperature part 2 of and then passes in direction of the arrows R with help of tubes 44 and 45 through its remaining cyclones, the lower cyclone 21 and the upper cyclone 22, from which then it is led out with the output tube 46.

The powdered raw material is fed in direction of the arrow V with the input 5 into the lower part of the tube 45, in which it is mixed with the streaming hot gas, which is supplied from the output 221 of the lower cyclone 21 and streams to the input 220 of upper cyclone 22. During the streaming of the powder-gas mixture a part of thermal energy of gas is transferred to the powdered raw material, than the powdered raw material is separated from the gas, which is then led in direction of the arrow R into the output tube 46, while the heated up powdered raw material is with the output tube 223 led in direction of the arrow S from the output 222 out of the upper cyclone 22. The output tube 223 is ended into the lower part of tube 44, then (the powdered raw material) will be once again mixed with gas, which streams out from the counter current shaft exchanger 20, which is working on principle of countercurrent exchange of heat between gas and powdered raw material were its temperature is in comparison to temperature in tube 45 higher. The powdered raw material, separated in the cyclone 21 is with the output tube 213 led in direction of the arrow S into the output 201 of gas of counter current shaft exchanger 20 , in which it passes against the direction of hot gas in direction of arrows S into its lower part. During the streaming of powder-gas mixture the raw material is heated up to a temperature, which is higher as the previous one, whereas the temperature of gas is decreasing. Tile described process is repeated in each cyclone 21, 22 of the low temperature part 2 and in cyclones 11, 12, 13 of the high temperature part 1 of the exchanger, whereas after passing through each stage the temperature of powdered raw material is increased, and the raw material continues to proceed in direction to input chamber 30 of rotary kiln 3 in direction of arrows S, and on contrary, the hot gas proceeds in direction of arrows R to the output tube 46 and its temperature is stepwise decreasing. The powdered raw material, separated in individual stages of the heat exchanger, is on contrary to gas passing in direction of arrows S, that means against the direction of hot gas stream S, from the input 5 to the input chamber 30 of the rotary kiln 3, whereas it accepts stepwise between the individual stages of the exchanger the heat from hot gas.

The transmission of mediums between the high temperature part 1 and the low temperature part 2 is realized such a way, that the hot gas is led from the output 131 of the third cyclone 13 to the input 200 of counter current shaft exchanger 20 with help of an independent interconnecting tube 4. The already partly pre heated powdered raw material, leaving the low temperature part 2 of exchanger, is led with help of the output tube 203 of the output 202 of counter current shaft exchanger 20 into the transport tube 50 and with this tube—when previously mixed with external warm gas stream, which is led into the beginning 500 of the transport tube 50 in direction of the arrow T—is led into the corresponding stage of high temperature part 1 of the exchanger.

As it is demonstrated on the Picture no. 2, with completion of the construction with addition of additional fuel and combustion gas with help of inputs 6 and 60 could be the capacity, eventually the efficiency of the system increased so, that the temperature conditions of hot gas entering to the high temperature part 1 are adjusted to optimal operational value. Similarly with addition of gas and precalcinated powdered raw material through the input 51 to the lower part of output tube 41 the final composition and properties of powdered raw material can be modified, which after passing the first cyclone 11 enters into the input chamber 30.

It is evident that the design of cyclone heat exchanger is not limited to the mentioned examples. The number of cyclones in the high temperature part 1 and in the low temperature part 2 has to be not the same. A precondition of its function it is however, that in each mentioned stages there are at least two cyclones. Also the value of mutual height difference of the connection of the highest and so in relation to the hot gas stream direction R the last cyclone of high temperature part 1 to the input to the low temperature part 2 that means to the input 200 of its counter current shaft exchanger 20, can be—at preserving a lower level of connection of the low temperature part 2—different and can be chosen according to given temperature conditions and the form of design.

INDUSTRIAL APPLICABILITY

The construction of in height reduced heat exchanger according to the invention can be used namely for preheating of raw material farina at dry method of cement clinker production.

What is claimed is:

1. Lower, in height reduced, heat exchanger for preheating of powdered raw material composed from a system of cyclones, where the exchanger is divided into two parts, to a high temperature part closer to the hot gas source and to a low temperature part, where each part is composed from at least two serially one after the other arranged cyclones which are oil different height level and which are mutually interconnected with a connecting tube of hot gas such a way, that the input of first cyclone is connected to the hot gas source and the output from each cyclone is assigned to the input of next cyclone, where the output of separated powdered raw material is from each cyclone led to the beginning of the tube assigned to the output of hot gas from the previous cyclone and that the high temperature part and low temperature part of the exchanger are mutually interconnected with an interconnecting tube and the two parts are situated in different height level so, that the input to the low temperature part is situated lower as the output from the high temperature part and that the high temperature part is further provided with a transport tube, which is ended to the tube, connecting the supply of hot gas to its highest cyclone and to which the output tube of low temperature part of heat exchanger is ended, characterized by that the lowest member of low temperature part (2) is composed from a counter current shaft exchanger (20), where its output (202) is ended to the transport tube (50).

2. Lower heat exchanger according to the claim 1, characterized by that the input part (500) of transport tube (50) is situated under the level of output (202) of powdered raw material from the counter current shaft exchanger (20).

3. Lower heat exchanger according to the claim 1, characterized by that the into the output tube (41) arranged between the input chamber (30) of rotary kiln (3) and the first cyclone (11) of high temperature part (1) the input of fuel (6) and the input of combustion gas (60) are ended.

4. Lower heat exchanger according to claim 1, characterized by that to the output tube (41), arranged between the input chamber (30) of rotary kiln (3) and the first cyclone (11) of high temperature part (1) the input(51) of hot gas and precalcined raw material is ended.

* * * * *